US007730907B2

(12) United States Patent
Richter

(10) Patent No.: US 7,730,907 B2
(45) **Date of Patent: *Jun. 8, 2010**

(54) DEVICE, WITH VANES, FOR USE WITHIN A PIPELINE, AND PIPELINE ARRANGEMENT INCLUDING SUCH DEVICE

(75) Inventor: James R. Richter, Lincolnshire, IL (US)

(73) Assignee: The Metraflex Company, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/715,757

(22) Filed: Mar. 8, 2007

(65) Prior Publication Data

US 2007/0215226 A1 Sep. 20, 2007

Related U.S. Application Data

(62) Division of application No. 10/624,033, filed on Jul. 21, 2003.

(51) Int. Cl.
*F15D 1/04* (2006.01)

(52) U.S. Cl. ..... 138/37; 138/39; 138/118; 222/547; 222/564

(58) Field of Classification Search ..... 138/39, 138/44, 118, 37; 222/56, 547; 210/163, 210/164
See application file for complete search history.

(56) References Cited

U.S. PATENT DOCUMENTS 1,689,446 A * 10/1928 Miller et al. ..... 138/37
1,852,380 A * 4/1932 Tabor et al. ..... 138/37
2,478,998 A 8/1949 Fisher et al.
2,482,747 A * 9/1949 Davis et al. ..... 209/157
2,688,985 A 9/1954 Holdenried
2,689,017 A * 9/1954 Schmid ..... 210/164
2,788,719 A * 4/1957 Bennett ..... 162/339
2,929,248 A 3/1960 Sprenkle
3,029,094 A 4/1962 Parlasca et al.
3,049,009 A 8/1962 McCall et al.
3,113,593 A 12/1963 Vicard
3,224,170 A * 12/1965 Iwanaga et al. ..... 96/342
3,616,693 A * 11/1971 Burgess ..... 73/861.34
3,645,298 A 2/1972 Roberts et al.
3,805,481 A * 4/1974 Armstrong ..... 210/614
3,827,461 A * 8/1974 Gilman ..... 138/39
3,840,051 A 10/1974 Akashi et al.

(Continued)

*Primary Examiner*—John Rivell
*Assistant Examiner*—Craig Price
(74) *Attorney, Agent, or Firm*—Greer, Burns & Crain, Ltd.

(57) ABSTRACT

A device for use in a pipeline including a fluid conduit section constructed of a flexible material. The fluid conduit section has a first end, which includes a first mounting arrangement, and a second end, which includes a second mounting arrangement. The fluid conduit section also has a length defined between the first and second ends, an internal diameter, and a fluid passage therethrough to allow fluid to flow from the first to the second end. The device also includes a plurality of longitudinally extending vanes positioned within the fluid conduit section, wherein radially inner edges of the vanes are in direct contact with the radially inner edges of adjacent vanes, and radially outer edges of the vanes contact one of the first and second ends, but are separated from the internal diameter of a remainder of the fluid conduit section, such that a space is defined therebetween.

26 Claims, 6 Drawing Sheets

U.S. PATENT DOCUMENTS 3,841,568 A 10/1974 Broad
3,945,402 A 3/1976 Murphy
3,946,650 A 3/1976 Culpepper, Jr.
4,056,977 A * 11/1977 Gau ..... 73/272 R
4,142,413 A 3/1979 Bellinga
4,154,265 A 5/1979 Holsomback
4,165,283 A * 8/1979 Weber et al. ..... 210/111
4,365,932 A 12/1982 Arnaudeau
4,366,746 A * 1/1983 Rosecrans ..... 138/125
RE31,258 E 5/1983 De Baun
4,408,892 A 10/1983 Combes et al.
4,420,016 A * 12/1983 Nichols ..... 138/103
5,092,366 A * 3/1992 Sakamoto ..... 138/37
5,195,784 A * 3/1993 Richter ..... 285/61
5,197,509 A 3/1993 Cheng
5,273,321 A 12/1993 Richter
5,307,830 A 5/1994 Welker
5,309,946 A 5/1994 Ligneul
5,323,661 A 6/1994 Cheng
5,363,699 A 11/1994 McCall
5,394,657 A * 3/1995 Peterson ..... 210/163
5,482,249 A 1/1996 Schafbuch et al.
5,495,872 A 3/1996 Gallagher et al.
5,529,084 A * 6/1996 Mutsakis et al. ..... 137/13
5,588,635 A 12/1996 Hartman
5,762,107 A 6/1998 Laws
5,937,908 A 8/1999 Inoshiri et al.
6,012,492 A 1/2000 Kozyuk
6,014,987 A 1/2000 List et al.
6,035,897 A 3/2000 Kozyuk
6,065,498 A 5/2000 Campau
6,145,544 A 11/2000 Dutertre et al.
6,186,179 B1 2/2001 Hill
6,289,934 B1 9/2001 Welker
7,347,223 B2 * 3/2008 Richter ..... 138/37
2003/0072214 A1 * 4/2003 Fleischli et al. ..... 138/39

* cited by examiner

DEVICE, WITH VANES, FOR USE WITHIN A PIPELINE, AND PIPELINE ARRANGEMENT INCLUDING SUCH DEVICE

This is a divisional of application Ser. No. 10/624,033, filed Jul. 21, 2003.

FIELD OF THE INVENTION

The present invention relates to flow stabilizers and more particularly to flow stabilizers for use in pipes.

BACKGROUND OF THE INVENTION

A known characteristic of fluid flow, such as the flow of liquid in a pipe, is the turbulence of the flow. Turbulence in a pipeline can be created by bends in the pipe run, connections with other pipes, partially opened valves, constrictions in the pipe, as well as moving mechanical devices such as the moving elements of a pump such as a pump rotor, diaphragm, vanes, etc.

Frictional losses and other problems develop as a result of turbulent flow, which problems disappear or diminish as flow becomes more laminar. There are known devices used to reduce turbulence in a fluid flow such as the flow straightening devices shown in U.S. Pat. Nos. Re. 31,258; 3,946,650; 2,929,248; 3,113,593; 3,840,051; 5,307,830; 5,309,946; 5,495,872; 5,762,107; 6,065,498; and 6,145,544.

Devices such as those disclosed in U.S. Pat. Nos. 5,197,509 and 5,323,661 are known to eliminate or reduce elbow induced turbulence in pipe flows, being positioned upstream of the elbow. These devices actually change a straight flowing stream and impart a rotation to them about the flow axis and upstream of the elbow.

In certain pipe line configurations, fluid control devices such as valves are provided in the pipe line downstream from a pump or other turbulence causing structure such as a pipe elbow. For example, the valve may be a check valve to prevent the reverse flow of fluid when the pump is not operating, the valve may be used to completely pinch off the pipeline to stop the flow of fluid, without shutting off the pump, the valve may be used to throttle the fluid flow through the pipe downstream of the pump as a way of fine tuning or balancing the flow volume to meet different requirements, even though the pump might normally provide a greater flow volume than is desired. Some valves combine two or all three of these features.

When valves of these types are used downstream of a pump, it is standard and customary practice to space the valve 5 to 10 pipe diameters downstream of the pump. This is necessary to allow the turbulence created by the pump to subside, to allow the flow to become more laminar, so that operation of the pump is not hampered, such as excessive forces being applied to a partially closed valve. In situations where the pipe diameter is large, this requires a significant pipe run between the pump and the valve. For example, in the case of a 10 inch diameter pipe, the valve should be spaced 50 to 100 inches from the pump. Oftentimes the space for this length of pipe run is not available.

Therefore, it would be an improvement in the art if a device or arrangement were provided to allow for a shorter pipe length to extend between a pump or other source of turbulence in a fluid flow and a valve or other fluid control device that is negatively affected by turbulent flow.

SUMMARY OF THE INVENTION

The present invention provides a device or arrangement to allow for a shorter pipe length to extend between a pump or other source of turbulence in a fluid flow and a valve or other fluid control device that is negatively affected by turbulent flow.

A connecting segment of pipe is provided with a flow straightening device which significantly reduces the required length of pipe between the source of the turbulence, such as a pump, and the fluid control device, such as a valve. The connecting segment may be provided with other features, such as shock or vibration absorption, misalignment compensation, or fastener conversion elements.

These and other features and advantages of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

BRIEF DESCRIPTION OF THE DRAWINGS

FIG. 5 is a schematic illustration of a pipeline with a turbulence reducing system embodying the principles of the present invention.

DETAILED DESCRIPTION OF THE PREFERRED EMBODIMENTS

The present invention provides a device arranged to stabilize a fluid flow in an enclosed space, such as in a pipe line or other fluid conduit. Although the present invention is not limited only to pipelines, as an illustrative embodiment of the invention, it is shown in such an arrangement.

Figure 1:
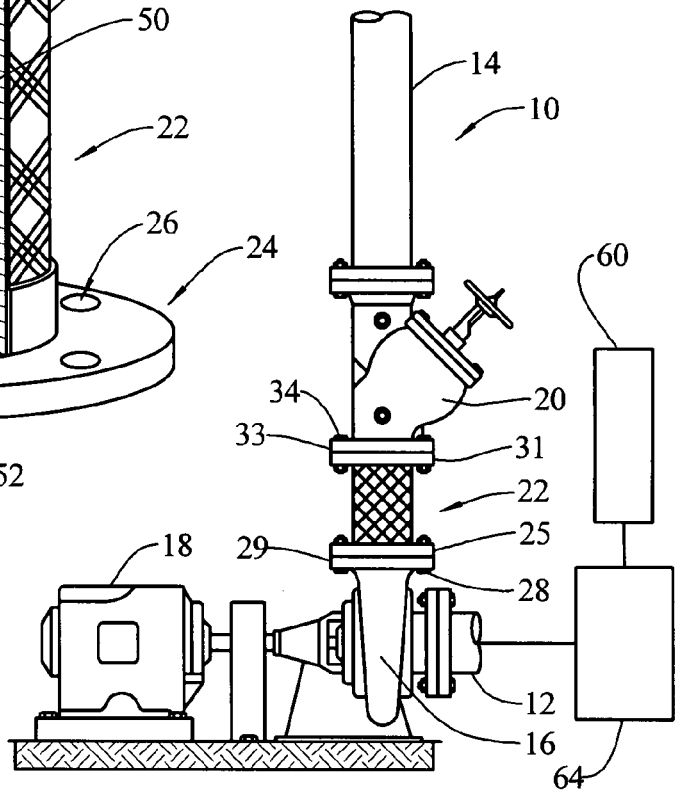
FIG. 1 is a side elevational view of a pipeline incorporating a flow stabilizer embodying the principles of the present invention.

In FIG. 1 a conduit in the form of a pipeline is illustrated generally at 10 and includes an upstream pipe portion 12 and a downstream pipe portion 14 arranged for carrying fluids in the downstream direction and interposed between the two pipe sections are a series of elements which act on the fluid flow. Specifically, a turbulence creating device, such as a pump 16 which may be driven by a motor 18 is used to draw in fluid from the inlet pipe section 12 and to drive that fluid toward the downstream pipe section 14. As a result of the action of the pump, which may incorporate moving internal components such as vanes, rotors, diaphragms, etc. as is well known in the art, turbulence is created in the fluid flow as the flow leaves the pump. Other types of turbulence creating devices in pipelines are well known and include bends or elbows in the pipe, changes in the pipe diameter, partially open valves or other flow restrictors, inlets or outlets to other pipes, and rough pipe interiors.

A fluid control device 20 in the form of a valve is positioned downstream of the pump 16 and may be used to control various features of the fluid flow as the fluid moves into the downstream pipe section 14. For example, the valve 20 may be a check valve which would prevent the reverse flow of fluid from the downstream pipe section 14 toward the inlet pipe section 12 in the event that the pump 16 stops operating. The valve 20 may be used to completely pinch off the flow of fluid from the inlet pipe section 12 to the outlet pipe section 14, even though the pump 16 may continue to operate. Further, the valve 20 may be used to throttle or balance the fluid flow from the inlet pipe section 12 to the downstream pipe section 14 so as to control the flow volume through the downstream pipe section 14, particularly in those instances where the pump 16 operates on a constant and fixed output level. The valve 20 may be able to supply one, two or all three of these different functions.

The proper operation of the fluid control device 20 is hampered when the fluid flow therethrough is turbulent. Specifically, back checking may be ineffective when a back check valve is placed in an area of turbulent fluid flow, precise control of the volume of fluid flow may not be achievable when a flow control valve is placed in a turbulent area and even the operation of a pinch off valve may be negatively affected if such a valve is placed in an area of turbulent flow. For these reasons, it has been necessary in the past to supply a straight length of pipe between a turbulence creating device, such as a pump, and a flow control device, such as a valve, with the length of straight pipe being on the order of five to ten pipe diameters. The present invention provides a flow stabilizing device 22 which can be inserted between the source of turbulence, such as the pump 16, and the flow control device 20 and has a length shorter than five to ten times the diameter of the pipe, to thereby reduce the spatial displacement requirement between the pump 16 and valve 20, in this case, which is particularly useful in situations where the pipe diameter is large.

Figure 3:
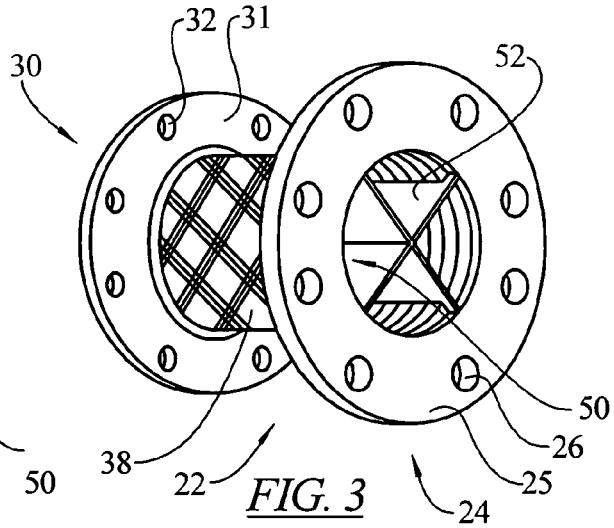
FIG. 3 is an end perspective view of the flow stabilizer.
Figure 2:
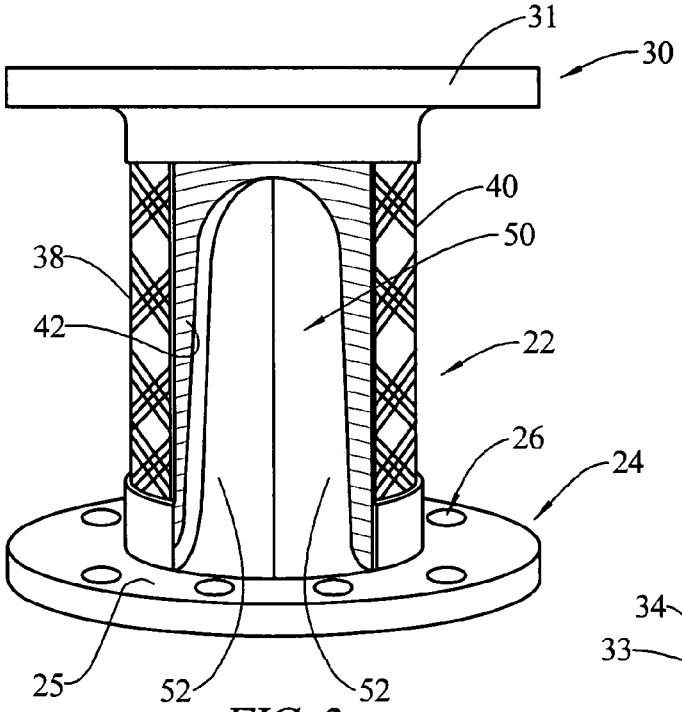
FIG. 2 is a side elevational view partially cut away of the flow stabilizer.

An embodiment of the pipe flow stabilizer of the present invention is illustrated in more detail in FIGS. 2 and 3.

The pipe flow stabilizer 22 has a first end 24 which includes a first mounting arrangement 26 for mounting the first end to a portion of the pipeline, for example, directly to the pump. In the embodiment illustrated, the first end 24 comprises a flange 25 and the first mounting arrangement 26 comprises holes formed in the flange to receive through bolts 28 (FIG. 1) which can extend through a similar flange 29 on the pump 16. Appropriate gaskets may be utilized between the pump flange 29 and the pipe flow stabilizer flange 25 to effect a fluid tight seal therebetween.

The pipe flow stabilizer 22 has a second end 30 with a second mounting arrangement 32 for mounting the second end to the pipeline, for example, directly to the valve 20. In the illustrated embodiment, the second end 30 may also comprise a flange 31 which mates directly to a flange 33 of the valve 20 and the mounting arrangement comprises a series of bolt holes 32 to receive through bolts 34 (FIG. 1) to clamp the two flanges together. Again, appropriate gaskets or other materials may be utilized to effect a fluid tight seal between the two flanges.

In other pipeline arrangements different types of mounting arrangements may be provided including male or female threaded portions, slip fit arrangements to be soldered or welded together, compression fittings and other well know fluid conduit connection arrangements. A different mounting arrangement may be provided at the first end 24 as opposed to the second end 30 to accommodate different connection needs for various components of the pipeline system, thus allowing the pipe flow stabilizer 22 to also function as a fastener conversion element where different components of the pipeline require different types of fastening or mounting arrangements.

Interposed between the first end 24 and the second end 30 is a conduit section 38 which is designed to contain the fluid flowing through the pipeline. Depending upon the fluid, the conduit section 38 may be required to be constructed of different materials, particularly where the fluid is corrosive or abrasive. The conduit section 38 may also be fabricated in a way to be able to absorb or dampen shock, vibration or mis-alignment in the pipeline system. For example, the walls of the conduit section 38 may be formed of a flexible and resilient material while still maintaining integrity to prevent leakage of the fluid contained therein. In the embodiment illustrated in FIGS. 2 and 3, the conduit section 38 is formed of a flexible metal hose commonly available in the industry which has an external metal braided layer 40 and internal corrugated pipe layer 42. Such a construction will permit and absorb axial and radial movements between the first end 24 and the second end 30 so that such movements are not transmitted along the pipeline, or are greatly reduced, while imparting no thrust load to the remainder of the pipeline.

Other types of absorbing conduit may be utilized, for example the flexible connector disclosed in U.S. Pat. No. 5,273,321 and incorporated herein by reference, could be utilized for the conduit section.

Internal of the flow stabilizer 22 is a flow straightening device 50 which is used to straighten and stabilize the fluid flow, causing the fluid flow to transition from a turbulent flow towards a laminar flow. The flow straightening device may comprise a plurality of vanes 52 extending longitudinally in the fluid conduit. For example, in the embodiment illustrated, the flow straightening device 50 comprises four vanes 52, with each vane arranged perpendicular to adjacent vanes. The vanes 52 may extend along a portion of the distance between the first end 24 and second end 30, that is, they may be of a length less than, equal to, or greater than the distance between the first end and second end. Further, in this embodiment, the entire fluid conduit section (38) includes no structures within its internal diameter, other than the plurality of longitudinally extending vanes (52), that would obstruct fluid flowing through the first end (24) towards and then through the second end (30). Also, the vanes may extend across the full internal diameter of the fluid conduit 38 or they may be shaped in a manner wherein they do not occupy the entire internal diameter of the fluid conduit. For example, as illustrated in FIG. 2, the vanes are provided with a hydrodynamic shape, that is, a shape which further assists in the transition from turbulent flow towards laminar flow such that the edges of the vanes are formed of soft or gentle curves without abrupt changes in direction. This shape assists in stabilizing the fluid flow and helps to prevent vortex shedding and other turbulent events. This shape also allow for lateral or radial movement of the second end 30 without causing the vanes to contact the inside layer 42 of the conduit section 38. Other configurations of flow straighteners, including a plurality of thin walled pipe lengths, screens, perforated plates and other arrangements, such as disclosed in U.S. Pat. No. 5,495,872 and incorporated herein by reference, could be utilized.

Figure 4:
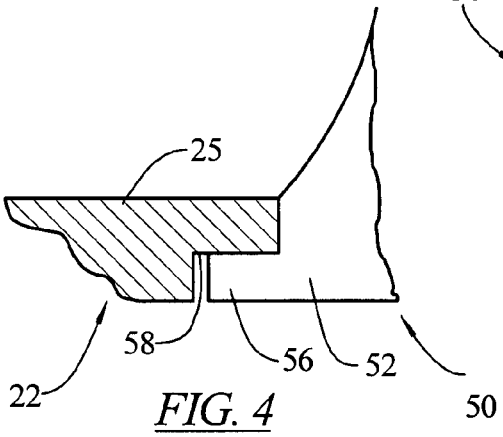
FIG. 4 is a partial side sectional view of a valve mounting arrangement.

An arrangement for mounting the flow straightening device 50 to the pipe flow stabilizer 22 as illustrated in FIG. 4. In this embodiment, the flow straightening device 50 comprises vane 52 which has an enlarged foot portion 56. The foot portion 56 is captured in a recess 58 formed in the first end flange 25. The vane 52 could be welded, epoxied or secured in some other fashion to the flange 25 if it is desired to secure the two components together. Otherwise, the vane structure 52 could be loosely captured in the fluid conduit 38 with the foot 56 engaged by the recess 58 of the flange 25 to prevent downstream movement of the vanes 52. However, in most situations, due to the turbulence at the first end 24, it is preferred to secure the flow straightening device 50 to the remainder of the pipe flow stabilizer 22.

As a further enhancement to the invention, or as a separate element, a device 60 may be provided to reduce or eliminate turbulence at the turbulence creating device, such as an elbow 64 or other discontinuity in the pipeline. For example, in the pipeline illustrated in FIG. 1, often times the upstream pipe section 12 comprises an elbow 64 (shown schematically) leading directly into the pump 16. If the flow of liquid into the pump 16 is turbulent, then the operation of the pump is less efficient and in some cases, damage to the pump could result. In these situations, it would be beneficial to introduce a turbulence reducing device 60 (shown schematically in FIG. 1), such as those disclosed in U.S. Pat. Nos. 5,197,509 and 5,323,661, and incorporated herein by reference, upstream of the turbulence creating device to reduce or eliminate any turbulence that might otherwise be created.

Figure 5A:
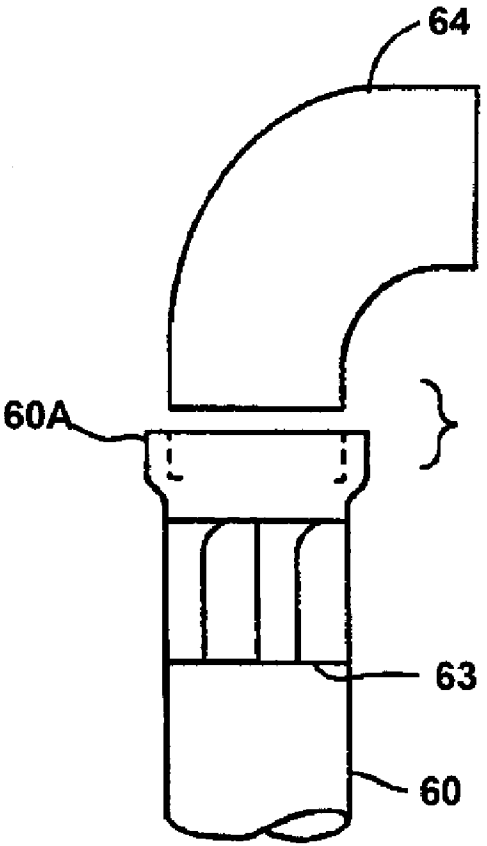
FIGS. 5A-5C, hereinafter collectively referred to as FIG. 5, illustrate one embodiment of the turbulence reducing device ahead of an elbow and the mathematical relationship between the turning radius, the pipe diameter and the total angle of turns.
Figure 5B:
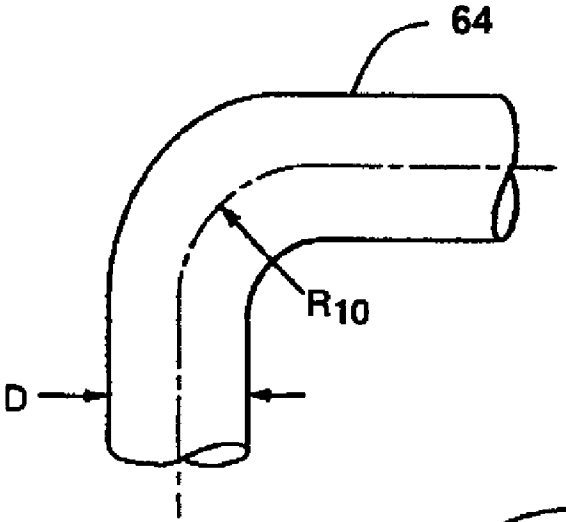
Figure 5C:
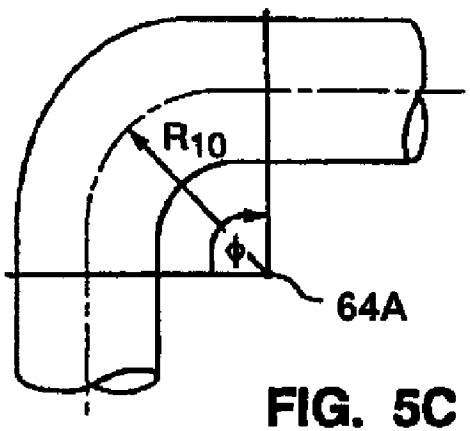

FIG. 5 is an illustration of the one embodiment of turbulence reducing device 60 and its relationship to the elbow turns. The turbulence reducing device 60 is located in a pipe ahead of the elbow 64 connected to pipe flange 60A. The relationship of the turning angle will be shown later; however, the relationship relates to the geometry of the elbow 64 according to the diameter of the elbow D and the turning radius $R_{10}$. 28 is the center of the rotation of the elbow.

Figure 6A:
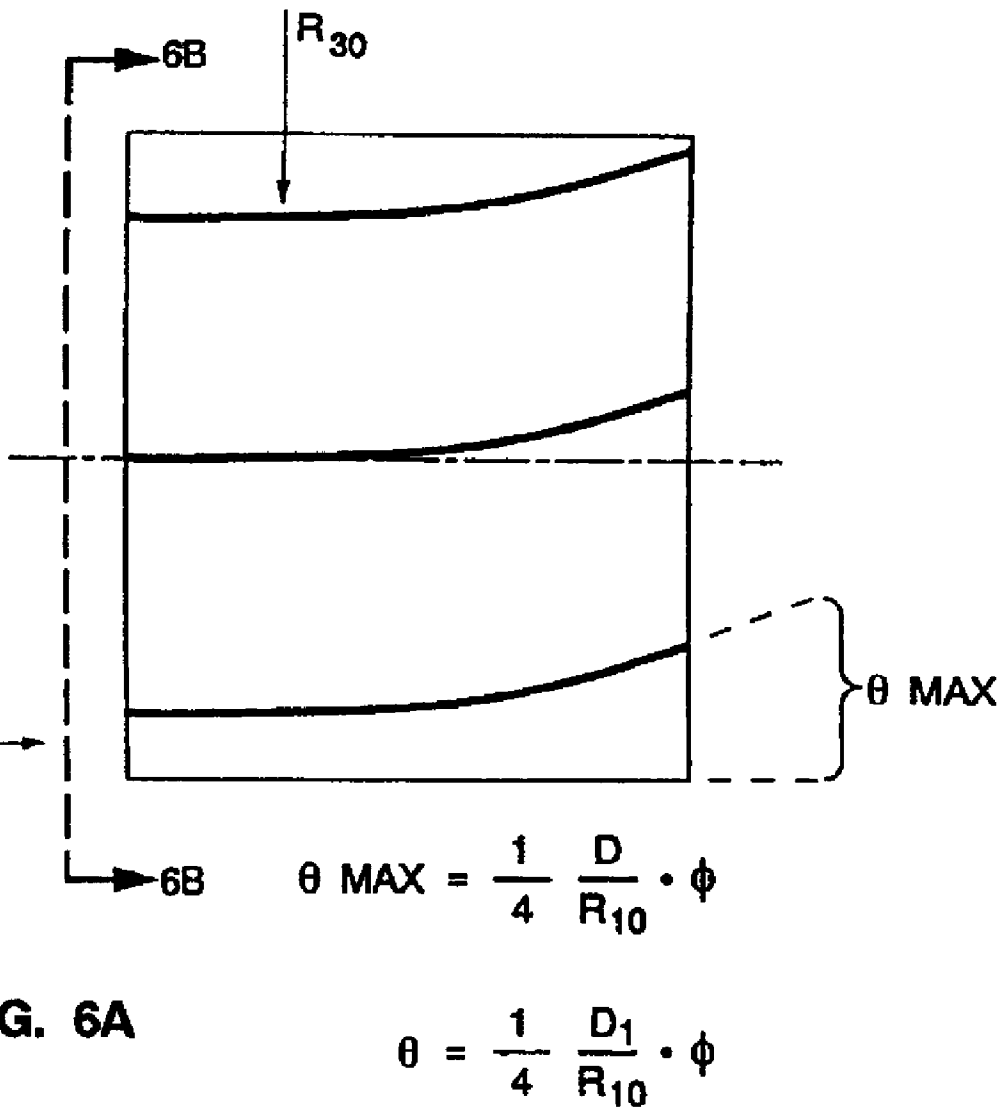
FIG. 6A illustrates a side view of one embodiment of the turbulence reducing device.
Figure 6B:
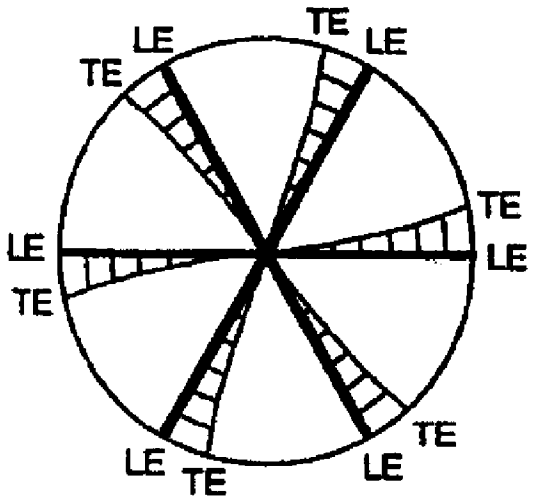
FIG. 6B illustrates a head-on view of one embodiment of the turbulence reducing device.

FIG. 6A illustrates the results of a typical geometry viewed in the direction of the fluid flow, and also on the side, as shown in FIG. 6B, wherein the fluid flowing through a pipe has a central axis. As one can see by the direction of the fluid flow, the turning vanes which are symmetrically oriented around the fluid flow axis, each vane has a compound curvature that is a result of the rotation in the axial direction and also in the R direction. In the axial direction, the angle is called a Theta, and on the side view, we can see the fluid goes into the turning vane without any angle of attack, coming out with a maximum angle Theta max, and the radius for the fluid to reach the Theta max is called $R_{30}$. According to simplified mathematical calculations under rotational transformation, the Theta max is equal to one quarter the pipe diameter divided by the radius of the turn ($R_{10}$) times the total inclusion angle of the turn (Phi). For any angle in between the center line to the outer edge (Theta 1), simply substitute the pipe diameter with the appropriate diameter (D1). The projected view would have a compound curve, as shown in cross section. The radius of considered. It is also a critical design parameter when wet steam is flowing through the turning vane. Separate droplets or particles will be carried by the stream under a relatively small velocity to the stream, called a slip stream, such that the centrifugal force should be smaller than the slip stream so the particles will be rotating with the fluid instead of separating from the streamline and hitting the wall. The radius ($R_{30}$) relates to the maximum diameter of the particle the stream is carrying.

Figure 7:
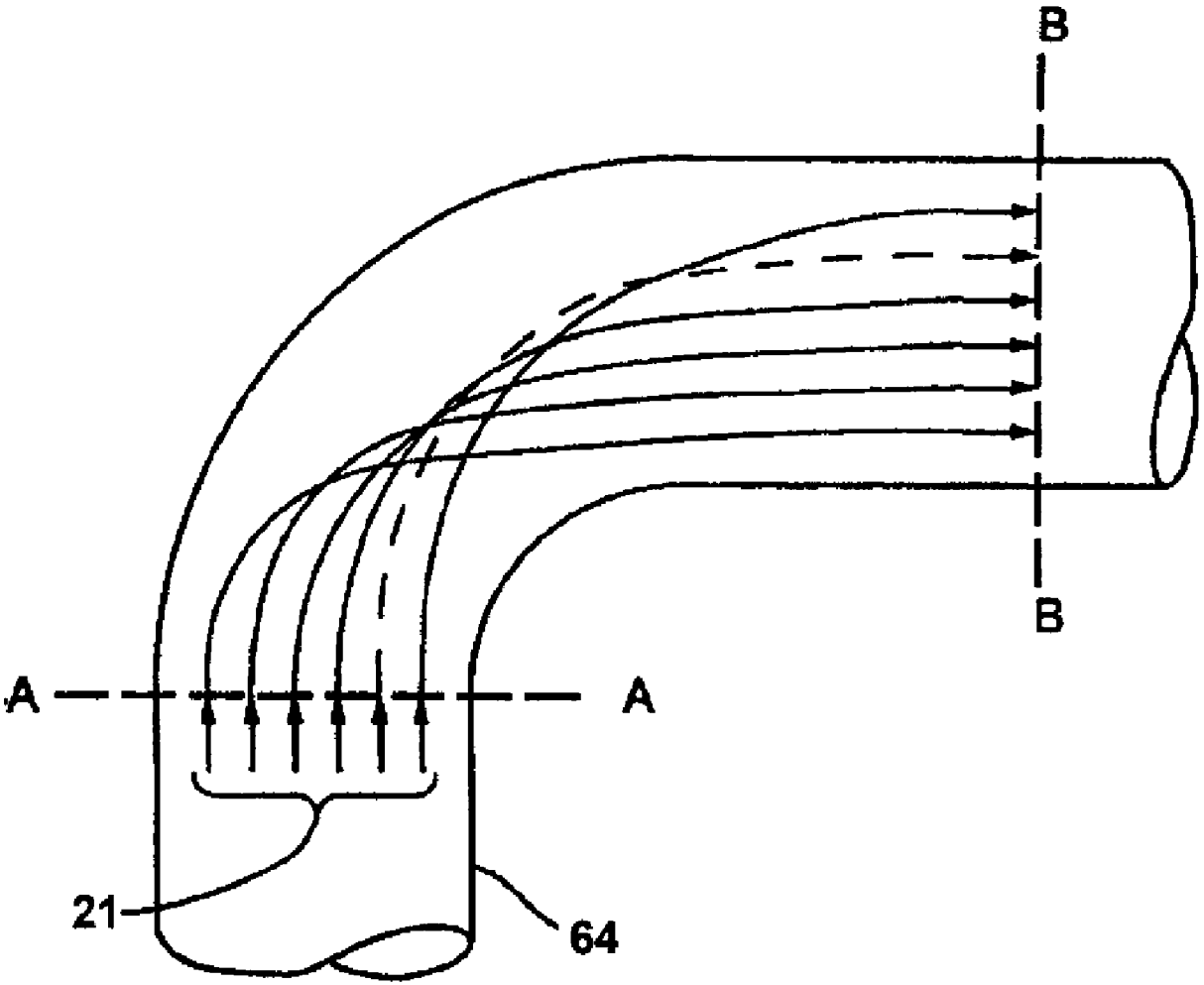
FIG. 7 is an illustration of equal streamline length flow desired to achieve rotational transformation mathematically.

In FIG. 7, the elbow system 64 would require a different streamline pattern as depicted by 21 than prior art devices that do not use the present turbulence reducing device. The streamline would require the same length starting from cross section AA, and would reach cross section BB at the same time and at the same velocity by designing a pre-rotational flow according to the rotational transformation formula. In general, the streamline is more complicated than this; however, this illustrates a typical 90 degree turn elbow only. A feature of the turbulence reducing device under the rotational transformation rule is that the streamline started on the outermost wall of the pipe, after going through the elbow, reaches the innermost wall of the elbow, and the streamline on the innermost wall of the elbow will reach the outermost position after going through the elbow. The inside streamlines generally have no change in position; in other words, no rotation occurs at the center lines. It was demonstrated later by the turbulence reducing device design, according to rotational transformation, that if the turning vane is designed properly, the fluid will have a rotation above the center line and also perpendicular to the center line, creating a compound curve to compensate for the rotation due to the elbow. The reason it requires two components of rotation to compensate for one rotation is due to the vector analysis of three-dimensional Curl functions. The Curl function requires the cross product of a vector, normally consisting of two terms; therefore, the pre-rotator has to be designed accordingly to make the total compensation work. Experimentally, the invention shows that when the turbulence reducing device is properly designed, the fluid is pre-rotated entering the elbow and going through the elbow, reaching position BB. From thereon, the fluid stops rotation all by itself, and the fluid in the pipe is going straight beyond that point. In other words, turbulence is not generated through the elbow, and cavitation on the inside and outside is totally eliminated. The velocity of the fluid going through the elbow maintains a constant pace without acceleration or deceleration, which is the main cause of the droplets carried by the fluid to be separated from the main bodies.

Figure 8:
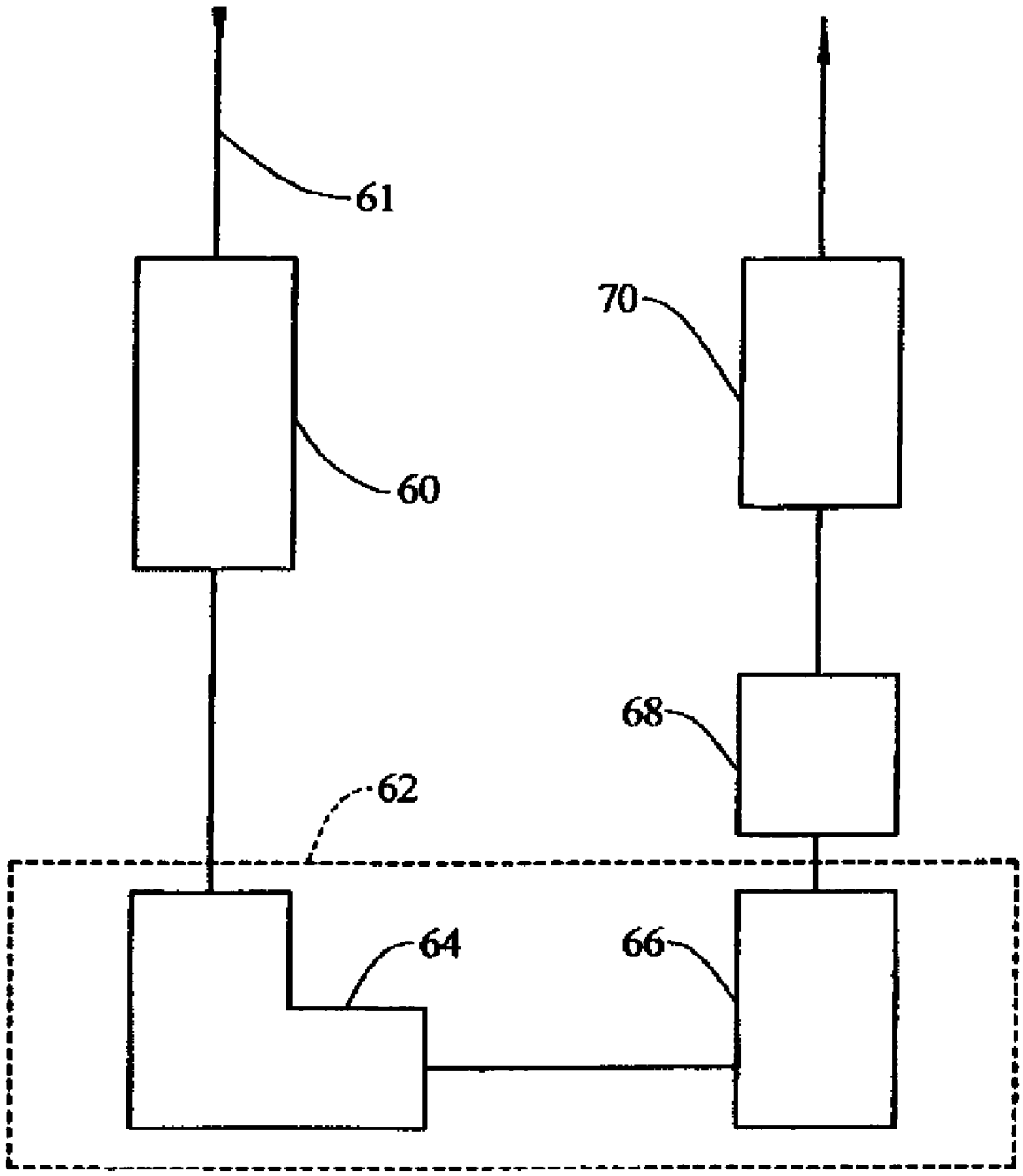
FIG. 8 is a schematic illustration of a pipeline with a turbulence reducing system embodying the principles of the present invention.

As shown in a schematic illustration in FIG. 8, when a turbulence reducing device 60 is used in a pipeline 61 with a flow straightening device incorporating the principles of the present invention, the flow would first encounter the turbulence reducing device 60, then a turbulence creating device 62, such as an elbow 64 or pump 66, or the combination of an elbow and a pump, and then the flow would encounter a flow straightening device 68 and finally the fluid control device 70, such as a valve. In situations where no fluid control device is positioned closely following the turbulence creating device 62, the flow straightening device may be omitted. Thus, for example, where an elbow closely precedes a pump, the turbulence reducing device 60 would still be of value and benefit by conditioning the flow entering the pump.

Figure 9:
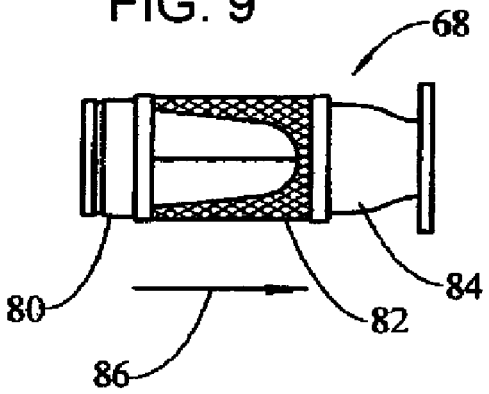
FIG. 9 is a side elevational view of another embodiment of the flow stabilizer.

The flow straightening device 68 of FIG. 8 could be a flow straightening device as shown at 22 in FIGS. 1-4, or could be provided in other embodiments and with other attachments, such as shown in FIGS. 9-12. In FIG. 9, the flow straightening device 68 is comprised of a first connection end 80, a flow straightening portion 82 and a reducer connection 84 with the flow through the straightening device being in the direction of arrow 86. The connection end 80, as illustrated comprises a groove connection for mating to another piping section with an appropriate connector, as is known. The connection end could also have a flanged connection as shown in FIGS. 2 and 3, or other types of connections, such as threaded ends or flush ends for attachment by welding or soldering.

Figure 10:
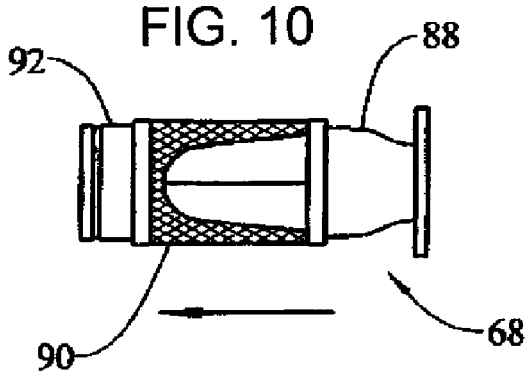
FIG. 10 is a side elevational view of another embodiment of the flow stabilizer.
Figure 11:
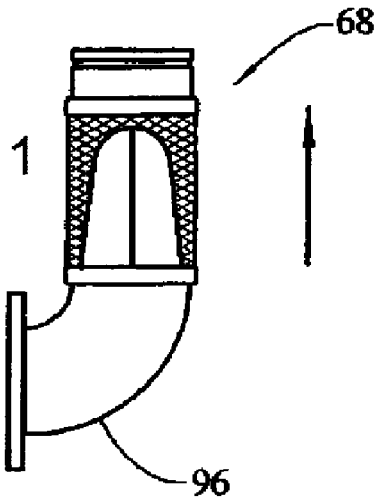
FIG. 11 is a side elevational view of another embodiment of the flow stabilizer.
Figure 12:
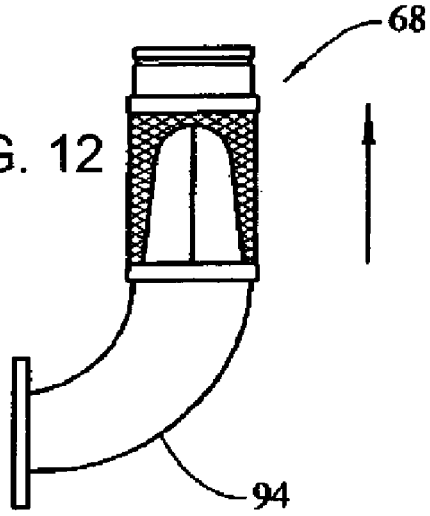
FIG. 12 is a side elevational view of another embodiment of the flow stabilizer.

The order of the parts could also be reversed as illustrated in FIG. 10 showing flow first through a reducer 88, then a flow straightening portion 90 and finally through a connection end 92. The reducer 88 could be replaced with a reducer/elbow 94 as shown in FIG. 12, or a straight, non-reducer elbow 96 as shown in FIG. 11. For each of these embodiments, the connection portion, at either the connection end or at the reducer or elbow, could be a flanged connection, a groove connection, a threaded connection or a weld/solder connection. As described above, the fluid conduit section having a length of less than five times the diameter, refers to the flow straightening portion, and not to the elbows, reducers or connection extensions that may be formed integrally or attached to the flow straightening portion. The elbows, connections and reducers, if provided, are considered to be a portion of the pipeline conduit rather than the fluid conduit section that provides the flow straightening, even though these parts may be formed integrally with or come preattached to the fluid conduit section.

Figure 13:
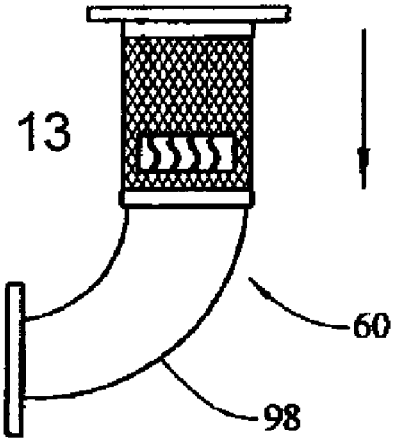
FIG. 13 is a side elevational view of an embodiment of the turbulence reducing device.
Figure 14:
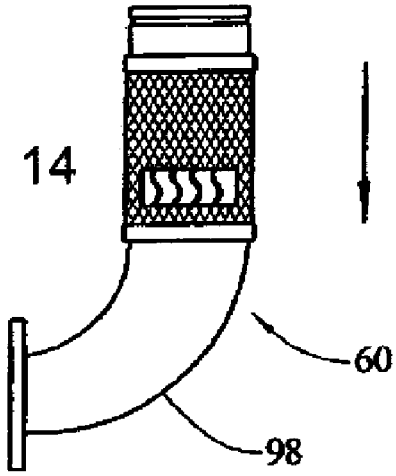
FIG. 14 is a side elevational view of another embodiment of the flow stabilizer.

The turbulence reducing device 60 could also be provided with attachments such as a reducing elbow 98 as shown in FIGS. 13 and 14, and may be provided with a flange end 100 (FIG. 13), a groove end 102 (FIG. 11), a threaded end or a weld/solder end.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

The invention claimed is:

1. A device for use in a pipeline, comprising:

a fluid conduit section constructed of a flexible material, to absorb at least one of shock, vibration and mis-alignment in said pipeline;

said fluid conduit section having a first end, which includes a first mounting arrangement for mounting said first end to the pipeline, and a second end, which includes a second mounting arrangement for mounting said second end to the pipeline;

said fluid conduit section having a length defined between said first and second ends, an internal diameter, and a fluid passage therethrough to allow fluid to flow from said first end to said second end; and a plurality of longitudinally extending vanes positioned within said fluid conduit section, wherein radially inner edges of said vanes are in direct contact with the radially inner edges of adjacent vanes and radially outer edges of said vanes contact one of said first and second ends, but are separated from said internal diameter of a remainder of said fluid conduit section, such that a space is defined therebetween.

2. The device according to claim 1, wherein each of said vanes extends generally parallel to a longitudinal direction of said device, such that said vanes straighten and stabilize said fluid flowing through said device.

3. The device according to claim 2, wherein each of said vanes has a hydrodynamic shape including at least one curve.

4. The device according to claim 2, further comprising at least four of said vanes, with each of said vanes being arranged perpendicular to adjacent vanes.

5. The device according to claim 1, wherein said fluid conduit section comprises a flexible metal hose.

6. The device according to claim 1, wherein said fluid conduit section comprises an elastomeric material.

7. The device according to claim 1, wherein said vanes are arranged to stabilize said fluid flowing through said device.

8. The device according to claim 1, wherein said vanes straighten the fluid flowing through said device.

9. The device according to claim 1, wherein at least one of said first and second mounting arrangements comprises a flange.

10. The device according to claim 1, wherein said first mounting arrangement and said second mounting arrangement each comprise a flange.

11. The device according to claim 1, wherein each of said first and second mounting arrangements comprises one of the following: a groove end, a threaded end or a weld/solder end.

12. A pipeline arrangement comprising:

a first piping section configured and arranged for carrying a fluid therethrough, said first piping section having at least one connector on an end thereof;

a second piping section configured and arranged for carrying a fluid therethrough, said second piping section having at least one connector on an end thereof; and a separate device mounted in said pipeline between said first and second piping sections, said device comprising:

a fluid conduit section constructed of a flexible material to absorb at least one of shock, vibration and mis-alignment in said pipeline, such that said fluid conduit section absorbs axial and radial movements, thereby essentially preventing transmission of said movements along said pipeline, while imparting no thrust load to a remainder of said pipeline;

said fluid conduit section having a first end, which includes a first mounting arrangement that matingly mounts said first end to said connector of said first piping section, and a second end, which includes a second mounting arrangement that matingly mounts said second end to said connector of said second piping section;

said fluid conduit section having a length defined between said first and second ends, an internal diameter, and a fluid passage therethrough to allow fluid to flow from said first end to said second end; and a plurality of longitudinally extending vanes positioned within said fluid conduit section, wherein radially inner edges of said vanes are in direct contact with the radially inner edges of adjacent vanes and radially outer edges of said vanes contact one of said first and second ends, but are separated from said internal diameter of a remainder of said fluid conduit section, such that a space is defined therebetween.

13. The pipeline arrangement according to claim 12, wherein each of said vanes extends generally parallel to a longitudinal direction of said device, such that said vanes straighten and stabilize said fluid flowing through said device.

14. The pipeline arrangement according to claim 13, wherein each of said vanes has a hydrodynamic shape including at least one curve.

15. The pipeline arrangement according to claim 13, further comprising at least four of said vanes, with each of said vanes being arranged perpendicular to adjacent vanes.

16. The pipeline arrangement according to claim 12, wherein said fluid conduit section comprises a flexible metal hose.

17. The pipeline arrangement according to claim 12, wherein said fluid conduit section comprises an elastomeric material.

18. The pipeline arrangement according to claim 12, wherein said vanes are arranged to stabilize the fluid flowing through said device.

19. The pipeline arrangement according to claim 12, wherein said vanes straighten the fluid flowing through said device.

20. The pipeline arrangement according to claim 12, wherein said first and second mounting arrangements each comprise one of the following: a flange, a groove end, a threaded end or weld/solder end.

21. A pipeline arrangement comprising:

a first piping section with at least one connector on an end thereof;

a second piping section with a first connector on an end thereof and a second connector on an opposite end thereof;

a pump connected to said second connector; and a device for use in said pipeline, said device comprising:

a fluid conduit section constructed of a flexible material to absorb at least one of shock, vibration and misalignment in said pipeline;

said fluid conduit section having a first end, which includes a first mounting arrangement that mounts said first end to said connector of said first piping section, and a second end, which includes a second mounting arrangement that mounts said second end to said first connector of said second piping section;

said fluid conduit section having a length defined between said first and second ends, an internal diameter, and a fluid passage therethrough to allow fluid to flow from said first end to said second end; and a plurality of longitudinally extending vanes positioned within said fluid conduit section, wherein radially inner edges of said vanes are in direct contact with the radially inner edges of adjacent vanes and radially outer edges of said vanes contact one of said first and second ends, but are separated from said internal diameter of a remainder of said fluid conduit section, such that a space is defined therebetween.

22. The pipeline arrangement according to claim 21, wherein said vanes are arranged to stabilize the fluid flowing through said device.

23. The pipeline arrangement according to claim 21, wherein said vanes straighten the fluid flowing through said device.

24. The device according to claim 1, wherein said entire fluid conduit section includes no structures within said internal diameter, other than said plurality of longitudinally extending vanes, that would obstruct fluid flowing through said first end towards and then through said second end.

25. The pipeline arrangement according to claim 12, wherein said entire fluid conduit section includes no structures within said internal diameter, other than said plurality of longitudinally extending vanes, that would obstruct fluid flowing through said first end towards and then through said second end.

26. The pipeline arrangement according to claim 21, wherein said entire fluid conduit section includes no structures within said internal diameter, other than said plurality of longitudinally extending vanes, that would obstruct fluid flowing through said first end towards and then through said second end.

* * * * *